United States Patent [19]

Etlinger

[11] Patent Number: 5,062,370

[45] Date of Patent: Nov. 5, 1991

[54] SLIP SHEET HAVING PERMANENTLY BENT PULL TAB AND METHOD OF MAKING THE SAME

[75] Inventor: Leon D. Etlinger, Aurora, Colo.

[73] Assignee: Baron Industries, Inc., Denver, Colo.

[21] Appl. No.: 547,803

[22] Filed: Jul. 3, 1990

Related U.S. Application Data

[63] Continuation-in-part of Ser. No. 67,602, Jun. 29, 1987, abandoned.

[51] Int. Cl.[5] ..... B65D 19/00

[52] U.S. Cl. ..... 108/51.3; 108/51.1

[58] Field of Search ..... 108/51.3, 561, 901, 108/902; 264/293, 339; 29/419 R; 428/43, 192

[56] References Cited

U.S. PATENT DOCUMENTS

| | | | |
|---|---|---|---|
| Re. 29,192 | 4/1977 | Anderson et al. | 108/51.3 |
| 2,302,137 | 11/1942 | Neuman | 108/51.3 X |
| 4,042,127 | 8/1977 | Brossia | 108/51.3 X |
| 4,051,285 | 9/1977 | Kramer | 428/43 |
| 4,198,912 | 4/1980 | Gramckow | 108/51.1 |
| 4,507,348 | 3/1985 | Nagata et al. | 108/901 X |
| 4,570,546 | 2/1986 | Batelka | 108/51.3 X |
| 4,649,007 | 3/1987 | Bonis et al. | 108/51.1 X |
| 4,738,153 | 4/1988 | Wong | 108/51.1 |

*Primary Examiner*—Jose V. Chen

*Attorney, Agent, or Firm*—Klaas & Law

[57] ABSTRACT

Herein is an idea related to creating and improving the ease of loading and unloading palletized materials. Its prime functions are to increase speed and ease of handling and to prolong the life of the plastic slip pallets.

By using a method to pull small unconnected lines or areas of an extruded plastic sheet downward, an upward angle will result on one or both sides of these indentations depending on their size, shape and design.

9 Claims, 2 Drawing Sheets

SLIP SHEET HAVING PERMANENTLY BENT PULL TAB AND METHOD OF MAKING THE SAME

This application is a continuation-in-part of my prior corresponding application Ser. No. 067,602 filed June 29, 1987, now abandoned, and the benefit of that filing date is claimed herein.

BACKGROUND OF THE INVENTION

This invention relates generally to a plastic slip pallet and/or pallet load divider sheet of the general type disclosed in U.S. Pat. Nos. RE 29,192 (3,776,145), 4,042,127 and 4,570,546, the disclosures of which are incorporated herein by reference.

SUMMARY OF THE INVENTION

This idea relates to improving the efficiency of the plastic slip sheet (slip pallet) by creating a permanently elevated end and/or side pull tab portion to allow easy access by a fork lift truck grabber bar device to securely grip the tab portion of the plastic sheet.

Herein is an idea related to creating and improving the ease of loading and unloading palletized materials. Its prime functions are to increase speed and ease of handling and to prolong the life of the plastic slip pallets.

By using a method to pull (displace) small unconnected lines or groove-like areas between the tab portion of the main load support portion of an extruded plastic sheet downward, an upward angle will result on one or both sides of these indentations depending on their size, shape and design.

BRIEF DESCRIPTION OF THE DRAWINGS

An illustrative and presently preferred embodiment of the invention is shown in the accompanying drawings wherein.

DETAILED DESCRIPTION OF THE INVENTION

The slip sheet 10 of the present invention is used in conjunction with fork lift trucks, to support a relatively heavy load of boxes, barrels, bags, etc. The slip sheet is carried by a platen (a thin sheet of steel or the like) attached to the fork lift truck, which can slide underneath the slip sheet and its load by means of pulling the slip sheet by an extending tab portion 12 with a grabber bar which is fixed to an upright backstop that is moveable front to back of the platen area usually by means of hydraulics or electronics to relocate loads of all shapes and sizes.

One of the problems that my occur when the fork lift driver attempts to attach the grabber bar to the slip sheet tab portion is, that the tab portion may be resting flat on the floor or surface from which the load is to be pulled onto the platen, making it difficult to grip the tab portion. Also, problems may occur when loads are double stacked and the tab portion of the slip sheet has bent downward. Either of these conditions can result in the lift truck driver not being able to secure a firm hold on the tab portion of the slip sheet or grabbing the tab portion in a manner causing it to fold and wrinkle in the grip of the grabber bar. It is very important that the tab portion of the slip sheet rest evenly across the length of the grabber bar.

The unique functional feature that I have added to the plastic slip sheet is indented patterns designed to make the tab or tabs of the plastic slip sheet be upwardly deflected and remain at a ready upward angle to achieve smooth effective fork lift handling and to reduce damage to the slip sheet.

Unlike a crease or shallow groove which will allow the extending tab to be manually positioned at an upward angle, the feature described herein and illustrated in the attached drawings (FIGS. 1–5) causes the tab of the slip sheet to angle upward automatically and remain at an upward angle when this or a similar pattern is indented into the surface of the finished plastic sheet.

For best results, the pattern should be used in conjunction with slip sheets made of polyolefin resins with a tensile strength range of 3,000 psi to 4,500 psi and a vicat softening point of 260 degrees F. Finished sheet thickness range is 20 to 100 mils.

Figure 1:
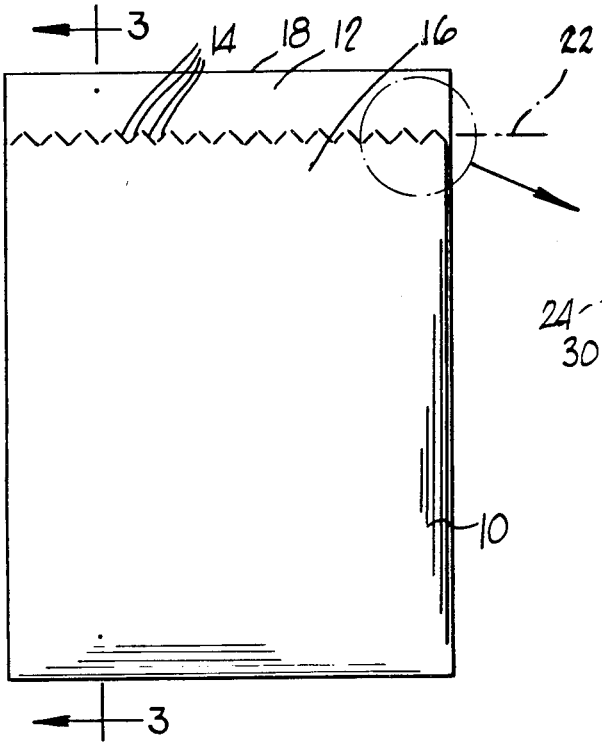
FIG. 1 is a top view of a slip sheet embodying the features of the invention.
Figure 6:
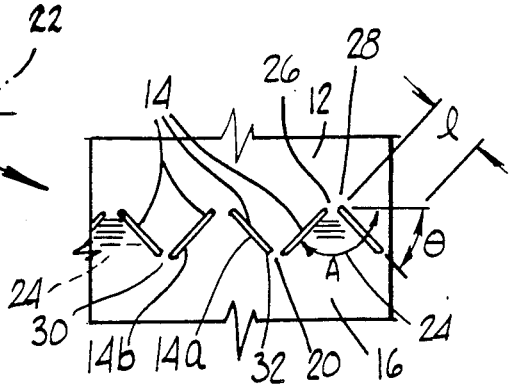
FIG. 6 is a detail view, at an enlarged scale, of a portion of FIG. 1.
Figure 2:
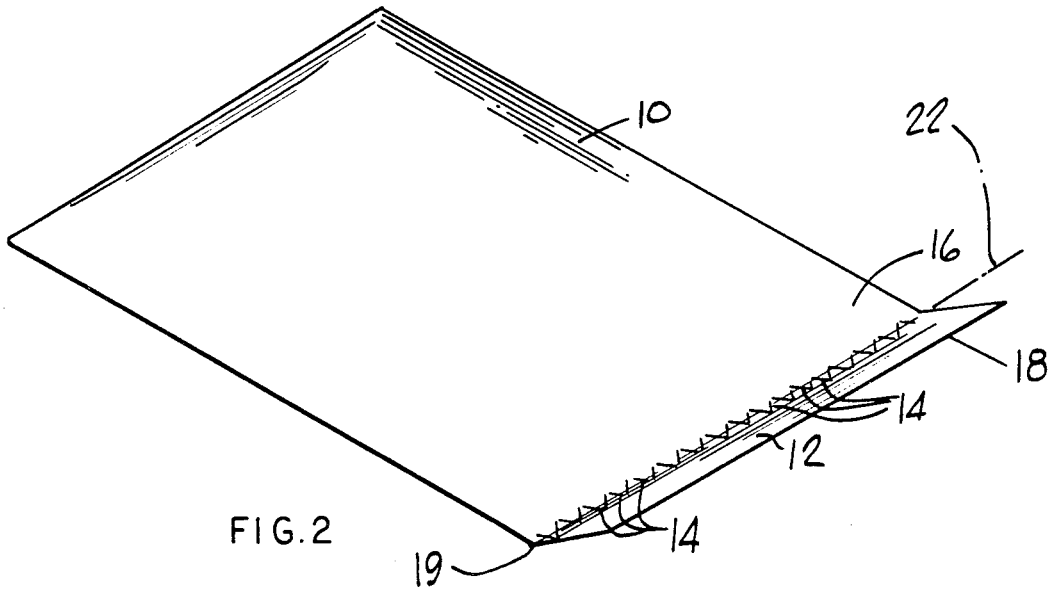
FIG. 2 is a perspective view of the slip sheet of FIG. 1.
Figure 3:
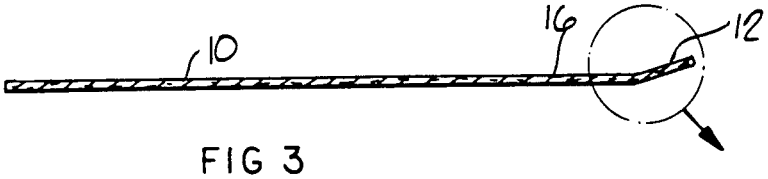
FIG. 3 is a sectional view taken along the line 3—3 in FIG. 1.
Figure 7:
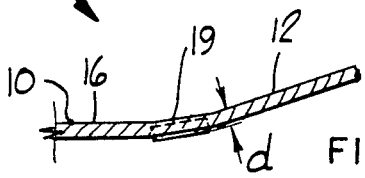
FIG. 7 is a detail view, at an enlarged scale, of a portion of FIG. 3.
Figure 4:
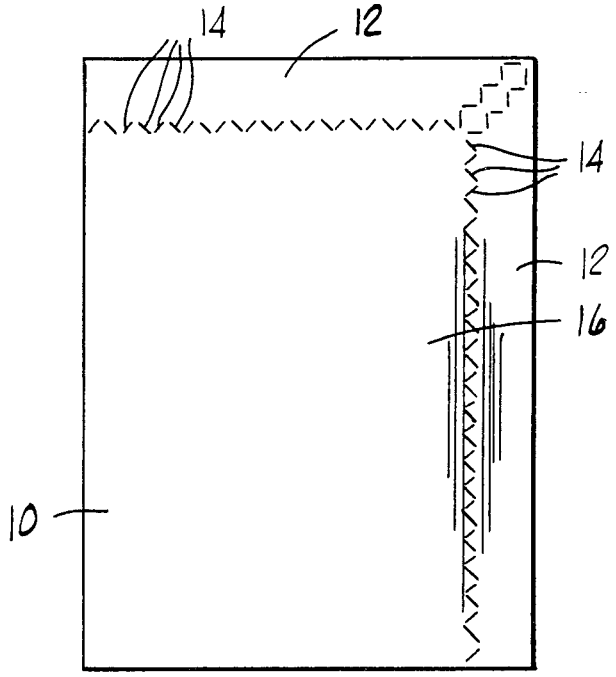
FIG. 4 is a plan view of another embodiment of the invention.
Figure 5:
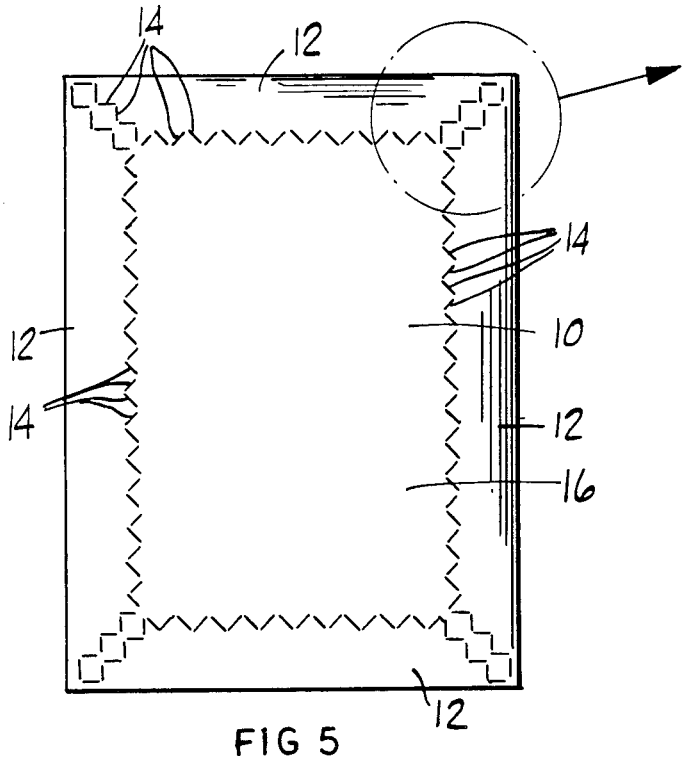
FIG. 5 is a plan view of yet another embodiment of the invention.
Figure 8:
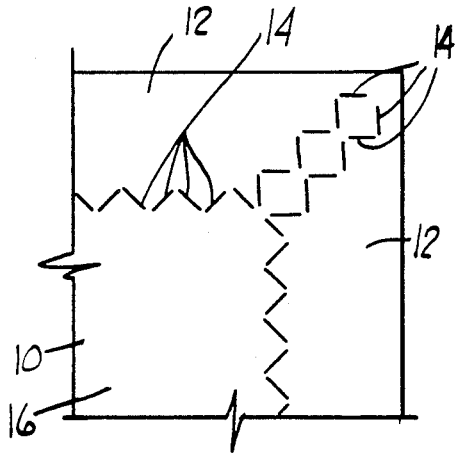
FIG. 8 is a detail view, at an enlarged scale, of a portion of FIG. 5.

The design comprises a pattern of alternating angled or otherwise shaped lines 14 indented into the plastic slip sheet surface between the load area 16 and the tab area 12 or areas. These indentations are pressed into the plastic slip sheet in a manner that causes the plastic to stretch downward (FIG. 3) wherever a line is placed. As the plastic is pulled downward the edge of the plastic sheet (or tab) automatically raises to a useful permanent upward angle (FIG. 2).

The angle $\theta$, length 1, shape, and depth d of the indented lines depends on the thickness of the plastic sheet, how wide the tab of the sheet is to be, and the amount of tab angle desired.

The indentations of the pattern are not quite connecting to one another (FIG. 1), nor do they extend completely to the edge of the sheet itself. The reason for this is that when the plastic is pulled downward in the indented line areas these indented areas become weaker than the other areas of the sheet that are not indented. Leaving a small space between these lines adds to the strength of the slip sheet tab.

The present invention provides a slip sheet for pulling a load positioned thereon onto the fork arms of a lift truck comprising a relatively thin sheet 10 of deformable plastic material having a flat main load support portion 16 and an inclined flat non-separable pull tab portion 12 with at least one substantially straight outer edge 18; the sheet having a series of discontinuous indentations 14 formed therein, the indentations defining a hinge-like boundary portion 19 between said support portion and said tab portion which is located in inwardly spaced relationship to the edge; the indentations having equal inclined angles $\theta$ of inclination with respect to the edge 18 and boundary 19, with the included angle of each indentation 14*a* being supplementary to the other angle A of each adjacent indentation 14*b* (i.e. $\theta+A=180$); the indentations have first predetermined lengths 1 and are separated from each other by relatively narrow-width unformed spaces 20 having second predetermined length and the first predetermined lengths are substantially larger than the second predetermined lengths; and the angle between the indentations and the edge is a specific value which provides a desired amount of nonlinearity between the sheet and the tab.

The invention further provides a slip sheet for supporting a load comprising a sheet 10 of deformable plastic material having a flat main load support portion 16; a non-separable integral pull flap portion 12 connected to the flat main load support portion by an elongated transverse hinge portion 19 having a longitudinal pivotal axis or cross-sectional area generally indicated at 22; the flap portion being outwardly inclined relative to the main load support portion; the hinge portion comprising a uniform continuous pattern of equal size and equally spaced separate discontinuous indentations formed in the plastic material between the load support portion and the pull flap portion in transverse (i.e., at an angle intersecting) relationship to the pivotal axis; the indentations have generally triangular-shape flat unformed sheet portions therebetween as indicated by broken shade lines 24; the indentations are elongated and adjacent ones 14*a*, 14*b* of the indentations are oppositely equally inclined relative to the longitudinal axis of the hinge portion; and the indentations have equal lengths and the indentations have a first pair of closely laterally spaced end portions 26, 28 and a second pair of widely laterally spaced end portions 30, 32.

The slip sheet comprises (a) a thin sheet of deformable plastic material having a flat main load support portion and an inclined flat non-separable pull tab portion with at least one substantially straight outer edge; (b) said sheet having a series of discontinuous indentations formed therein, said indentations defining a hinge-like boundary between said support portion and said tab portion which is located in inwardly spaced relationship to said edge; (c) said indentations having an angle of inclination with respect to said edge, with the angle of each indentation being supplementary to the angle of each adjacent indentation; and (d) said indentations have first predetermined lengths and adjacent indentations are separated from each other by spaces having second predetermined lengths, and said first predetermined lengths are substantially larger than said second predetermined lengths.

The invention also provides a slip sheet device for supporting a relatively heavy load comprising: a sheet of deformable plastic material having a flat main load support portion; a non-separable integral pull flap portion connected to said flat main load support portion by an elongated transverse hinge portion providing a longitudinal pivotal axis therebetween; said flap portion being outwardly inclined relative to said main support portion; and said hinge portion comprising a uniform continuous pattern of a plurality of equal size and equally spaced separate discontinuous indentations formed in said plastic material between said flat main load support portion and said pull flap portion and extending transversely relative to said longitudinal pivotal axis.

The indentations have first predetermined lengths and adjacent indentations are separated from each other by spaces having second predetermined lengths, and said first predetermined lengths are substantially larger than said second predetermined lengths.

For shipping purposes, plastic slip sheets are usually stacked and banded in quantities of between 300 and 1,000 depending on sheet thickness. When sheets are stacked in this manner the tendency is for the sheet to lay completely flat because of the weight accumulation of the sheets themselves. When a single sheet is removed from the stack of sheets to be put into use, the tab area of a sheet with the patterned indentation will slowly raise into a ready position.

Even if the tabs of this sheet are pressed out of position between loads of material in box cars or truck trailers, the tab will return to a functional position when the stress of the neighboring load is removed.

This particular idea is designed to take advantage of the memory qualities of the extruded polyolefin resins.

The invention provides a slip sheet having a series of indentations formed between the tab and the remainder of the sheet, with the indentations being arranged in a herringbone pattern angled relative to the edge of the sheet. By pressing indentations into the sheet at angles with respect to the edges, the plastic is locally stretched downward at the point of each indentation which causes the tab to automatically raise and permanently remain in this raised position where it can easily be gripped by the lift truck. With creases and grooves, such as are used in the prior art, it is necessary to mechanically fold the tab in order to angle it with respect to the rest of the slip sheet and, as a result, it easily can become flattened in use. In addition, the depth of the indentations and the spacing of the indentations and of the non-indented space between them determines the amount of inclination of the tab. The angle between the indentations and the edge of the sheet affects the amount of bending which is achieved.

The method of forming a slip sheet having a permanently bent tap on one edge comprises pressing a series of spacedapart indentations into the sheet. The subject method causes the tab to be bent with respect to the rest of the sheet automatically when the indentations are formed in the sheet and remain permanently bent in this orientation. With the prior art method, on the other hand, the tab must be manually bent after the crease or groove has been formed in the sheet, and it will not remain in this bent position in use.

It is contemplated that the inventive concepts herein described may be variously otherwise embodied and it is intended that the appended claims be construed to include the alternative embodiments of the invention except insofar as limited by the prior art.

What is claimed is:

1. A slip sheet device for supporting and pulling a load positioned thereon onto the fork arms of a lift truck comprising:

a sheet of deformable plastic material having a flat main support portion;

a flap portion non-separably connected to said flat main support portion by an elongation transverse hinge portion providing a longitudinal pivotal axis enabling resilient pivotal movement of said flap portion relative to said main support portion;

said flap portion being normally outwardly inclined relative to said main support portion;

said hinge portion comprising a uniform continuous pattern of equal size and equally spaced indentations formed in said plastic material; and the indentations have triangular-shape flat unformed sheet portions therebetween.

2. The invention as defined in claim 1 and wherein:

the indentations are elongated and adjacent ones of said indentations are oppositely equally inclined relative to the longitudinal axis of said hinge portions.

3. The invention as defined in claim 2 and wherein:

the indentations have equal lengths and adjacent ones of said indentations alternately provide a first pair of closely laterally spaced end portions and a second pair of widely laterally spaced end portions.

4. A slip sheet for pulling a load positioned thereon onto the fork arms of a lift truck comprising:

(a) a thin sheet of deformable plastic material having a flat main load support portion and an inclined flat non-separable pull tab portion with at least one substantially straight outer edge;

(b) said sheet having a series of discontinuous indentations formed therein, said indentations defining a hinge-like boundary between said support portion and said tab portion which is located in inwardly spaced relationship to said edge;

(c) said indentations having an angle of inclination with respect to said edge, with the angle of each indentation being supplementary to the angle of each adjacent indentation; and (d) said indentations have first predetermined lengths and spaced opposite end portions and said opposite end portions of adjacent indentations are separated from each other by spaces having second predetermined lengths, and said first predetermined lengths are substantially larger than said second predetermined lengths.

5. A slip sheet device for supporting a load comprising:

a sheet of deformable plastic material having a flat main load support portion;

a non-separable integral pull flap portion connected to said flat main load support portion by an elongated transverse hinge portion providing a longitudinal pivotal axis therebetween;

said flap portion being outwardly inclined relative to said main support portion; and said hinge portion comprising a uniform continuous pattern of a plurality of equal size and equally spaced separate discontinuous indentations formed in said plastic material between said flat main load support portion and said pull flap portion and extending transversely relative to said longitudinal pivotal axis.

6. The invention as defined in claim 5 and wherein:

said indentations have first predetermined lengths and spaced opposite end portions and said opposite end portions of adjacent indentations are separated from each other by spaces having second predetermined lengths, and said first predetermined lengths are substantially larger than said second predetermined lengths.

7. The invention as defined in claim 4 and wherein:

the indentations have triangular-shape flat unformed sheet portions therebetween.

8. The invention as defined in claim 7 and wherein:

the indentations are elongated and adjacent ones of said indentations are oppositely equally inclined relative to the longitudinal axis of said hinge portion.

9. The invention as defined in claim 8 and wherein:

the indentations have equal lengths and said indentations have a first pair of closely laterally spaced end portions and a second pair of widely laterally spaced end portions.

* * * * *